US008920147B2

(12) United States Patent
Guenther

(10) Patent No.: US 8,920,147 B2
(45) Date of Patent: Dec. 30, 2014

(54) SYSTEM FOR SEALING THE PISTON OF ROTARY PISTON MACHINES

(76) Inventor: Eggert Guenther, Bad Doberan (DE)

( * ) Notice: Subject to any disclaimer, the term of this patent is extended or adjusted under 35 U.S.C. 154(b) by 1241 days.

(21) Appl. No.: 12/312,524

(22) PCT Filed: Nov. 19, 2007

(86) PCT No.: PCT/EP2007/062488

§ 371 (c)(1),
(2), (4) Date: Feb. 1, 2010

(87) PCT Pub. No.: WO2008/065017

PCT Pub. Date: Jun. 5, 2008

(65) Prior Publication Data

US 2010/0150762 A1 Jun. 17, 2010

(30) Foreign Application Priority Data

Dec. 2, 2006 (DE) ..... 10 2006 057 003

(51) Int. Cl.

| | |
|---|---|
| ***F01C 19/06*** | (2006.01) |
| ***F04C 15/00*** | (2006.01) |
| ***F01C 19/04*** | (2006.01) |
| ***F01C 19/08*** | (2006.01) |
| ***F01C 21/08*** | (2006.01) |
| *F01C 1/22* | (2006.01) |

(52) U.S. Cl.

CPC ..... *F01C 19/04* (2013.01); *F01C 19/08* (2013.01); *F01C 21/08* (2013.01); *F01C 21/0881* (2013.01); *F01C 1/22* (2013.01)

USPC ..... 418/110; 418/111; 418/113; 418/121; 418/122

(58) Field of Classification Search

USPC ..... 418/113–114, 116–117, 119–120, 141, 418/144, 145–148

See application file for complete search history.

(56) References Cited

U.S. PATENT DOCUMENTS

| | | | | | |
|---|---|---|---|---|---|
| 428,740 | A | * | 5/1890 | Almond | 418/66 |
| 940,246 | A | * | 11/1909 | Hagerty | 418/109 |
| 1,528,075 | A | | 3/1925 | Richer | |
| 1,582,922 | A | * | 5/1926 | Freud | 418/110 |
| 1,721,358 | A | * | 7/1929 | Struble | 418/110 |
| 2,724,341 | A | | 11/1955 | Bilas | |
| 3,721,510 | A | * | 3/1973 | Gilbert | 418/113 |
| 3,768,936 | A | * | 10/1973 | McCormick | 418/142 |
| 3,794,450 | A | * | 2/1974 | Klomp | 418/117 |
| 3,830,600 | A | * | 8/1974 | Shimoji et al. | 418/113 |

(Continued)

FOREIGN PATENT DOCUMENTS

| | | |
|---|---|---|
| FR | 1.315.068 | 1/1963 |
| FR | 5 571 779 | 4/1986 |

*Primary Examiner* — Thomas Denion
*Assistant Examiner* — Steven D Shipe
(74) *Attorney, Agent, or Firm* — Jordan and Hamburg LLP

(57) ABSTRACT

A sealing system of rotary piston machines, the rotor excludes rotor discs which are arranged next to one another, and which are seated on the common rotor axle and are pressed apart from one another by acting spring and/or gas forces in the joints between the discs in such a way that the end sides of the discs which point towards the side walls of the housing bear sealingly against the latter and thus prevent the access of the medium to the axles. Assemblies comprising movable shaped lamellae which adapt to the changing joint widths and prevent an inner flow around the rotor are present in the part joints between the discs.

6 Claims, 12 Drawing Sheets

(56) References Cited

U.S. PATENT DOCUMENTS

| | | | | | |
|---|---|---|---|---|---|
| 3,844,692 | A * | 10/1974 | McLain | 418/113 |
| 3,873,249 | A * | 3/1975 | Rao | 418/113 |
| 3,995,976 | A * | 12/1976 | Ishizuka | 418/110 |
| 4,003,682 | A * | 1/1977 | Stein | 418/107 |
| 4,200,084 | A * | 4/1980 | Alexeev et al. | 123/222 |
| 4,397,620 | A * | 8/1983 | Inagaki et al. | 418/141 |
| 5,224,850 | A * | 7/1993 | Pie | 418/111 |
| 7,674,101 | B2 * | 3/2010 | Maeng | 418/258 |
| 2005/0180874 | A1 * | 8/2005 | Wells | 418/113 |
| 2010/0150762 | A1 * | 6/2010 | Guenther | 418/111 |
| 2012/0031370 | A1 * | 2/2012 | Guenther | 123/243 |

* cited by examiner

SYSTEM FOR SEALING THE PISTON OF ROTARY PISTON MACHINES

FIELD OF THE INVENTION

The present invention is directed to a principle and system of sealing rotary pistons against the enclosing casing wall of rotary compression and expansion engines.

BACKGROUND OF THE INVENTION

In the art of rotary piston engines, different solutions for achieving tightness, that is, sealing, of the piston against the enclosing casing wall during the course of movement are known. So-called rotor segment engines achieve an almost good tightness due to the high size accuracy of the components rotor, casing and blades which surround the operating space and yield the smallest possible gap between the components. In certain cases the tightness can even be improved by introducing a suitable fluid into the engine, causing a small fluid film to act as a sealing body between the components. When doing compression work with such engines gap losses must be accounted for. Such losses result in a reduction of the delivery output which can be compensated for by increasing the driving power of the compressor. In expansion engines the gap losses may lead to a loss in operation, especially when a damaging expansion takes place mainly via the gaps which result in providing ineffective rotary power of the rotor.

On the other hand, expanding media in high temperature conditions such as present in thermal engines can lead to a destruction of the engine as passing hot gases cause material erosion to component parts thereby increasing the gaps.

F. Wankel found that rotary combustion engines having more than three components moving in relation to each other, such as a rotor, movable piston parts fitted at the rotor, and casing, cannot function, as the sealing elements cannot be arranged such that during the course of motion of the engine, a unified spatial system of sealing lines having the same geometrical shape can be achieved. This defect is clearly visible in rotor segment engines. Though it may be possible to achieve a radial and axial tightness against the casing wall by spring sealing strips along the blade edges, the sealing line is interrupted in the area of the rotor hub by a remaining unsteadiness, which will lead to an untightness of the engine. Resulting from this experience, the rotary piston internal combustion engine developed by F. Wankel was an engine type having only 2 components moving in relation to each other and enclosing the working space: a casing with a trochoidal running way and a rotary piston also derived from a trochoid as internal enclosing body of the casing running way. Sealing strips can be fitted on this piston fulfilling the conditions of an unchanged geometrical shape. This type of engine has become known as Wankel engine.

In spite of the advantages and the successful development of this type of engine, certain technological targets could not be reached. The geometrically determined change in volume of the trochoid does not allow carrying out a traditional Diesel process. Though less important, the lubrication of the sealing strips and, connected with it, the heat dissipation from the piston to the casing wall are also concerns.

SUMMARY OF THE INVENTION

The aim of the invention is to create a sealing system for rotary piston engines which uses the principle of a similar geometrical shape of the sealing line according to Wankel so that other types of rotary piston engines for expansion and compression processes in higher temperature conditions can be used and which exhibit improved properties concerning change in volume, lubrication and heat dissipation.

The present invention relates to Wankel-type rotary piston engines in which sealing is improved through structural arrangements that achieve sealing across the rotor resulting in a more economical and environmentally friendly construction than previously possible, while retaining basic engineering principles.

In one aspect the invention relates to a rotor comprising two or more parallel rotor disc segments, the outer discs of which face the casing wall which disc segments are pressed by spring forces and/or gas pressure to the casing wall in such a way that their planar faces seal against the casing wall preventing circumferential flow, and the invention also relates to a closing of the gaps arising between the spaced rotor segment discs by sealing strips positioned within the gaps. Further the sealing strips are spring actuated to form a sealing in the direction in which the rotor runs in the casing so that the result is a system of thorough, even sealing lines which lack any interruptions.

In another aspect the invention relates to sealing strips comprising adjustable lamellae units formed of complementary pairs of lamellae which, with each other and together with the rotor disc segments form a labyrinth sealing against the casing. Also, the arrangement of the complementary pairs of lamellae into lamellae units allows the units to adapt by means of spring and/or media, i.e., fluid, forces to the geometric changes in the rotary piston engine caused in the course of movement, or by pressure and temperature.

In yet another aspect the invention relates to sealing strips, attached to the disc segments in the circumference of the casing running way, comprising lamellae units formed of complementary pairs of lamellae which overlap such that the units form sealing edges which, during the rotor movement, flexibly reach into the corner of the casing, thus sealing same and further, the invention relates to the lamellae units adapting to the radial and axial changes in the casing by means of spring forces.

In still another aspect the invention relates to the lamellae units having chamfers so that wedge-like compression elements act by spring force on the chamfers such that each of the complementary pairs of lamellae comprising a unit can be shifted with respect to each other in both directions of a plane and thus the lamellae units form sealing elements that can adapt in two directions to the space in which they are arranged.

In still yet another aspect of the invention, the rotor disc segments comprising the rotor have at the sides facing each other radial grooves into which the lamellae units are inserted so that the gaps between the disc segments are sealed by a flexible labyrinth sealing. Further, the rotor disc segments on the sides facing each other have ring grooves near the opening where the axle is positioned, into which either a closed ring can be inserted to seal the rotor against the axle or a disc segment] having a ring-shaped recess fitting into the opposite ring groove of the opposite disc and sealing the rotor against the axle.

Yet still further, the invention relates to the piston-forming rotor discs having on the outside recesses between the piston tips so that media forces such as fluid forces can act at these recesses which are contrary to the forces acting in the gaps and thus reduce the resulting compression forces against the casing walls to a size providing tightness (i.e., sealing) but minimising the friction forces.

Also, the invention relates to compression springs fitted between the rotor segment discs, which press the discs towards the outside during the starting of the engine at which time the media forces forcing the discs apart are not present.

In still yet another aspect, the invention relates to the disc segments formed so that they are formed lamellae together with other formed lamellae to form a labyrinth sealing.

BRIEF DESCRIPTION OF THE DRAWINGS

The disclosure of the invention is facilitated by reference to the following figures.

DETAILED DESCRIPTION OF THE INVENTION

Figure 1:
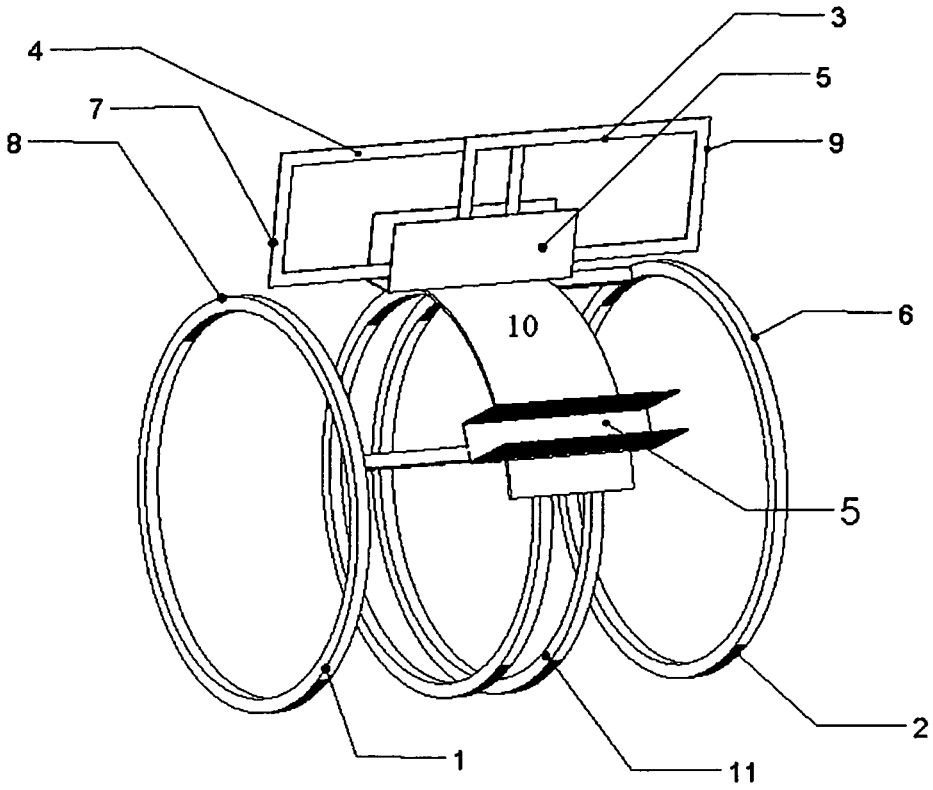
FIG. 1 is a perspective view of an adaptable sealing line of the present invention, at the rotor disc segment.

The principle of sealing is described with reference to FIG. 1. The rotor of the engine is divided into the two segment discs 1 and 2 which are pressed with their outer areas/surfaces 6 and 8 against the face sides of the casing 6 and 8 by spring/media forces and thus seal the rotor against the casing. The gap 11 between the segment discs is pressed inward against the rotor shaft by means of a rotating cover 10. Cover 10 is connected to guiding grooves 5 wherein the blades 3, 4 form one blade of the rotor segment. The blades 3, 4 are formed by lamellae, depicted as thin plates, which can adapt to geometric changes.

The implementation of the sealing principle is further described with reference to FIGS. 2*a*, 2*b* and 2*c*, 3*a*, 3*b*, 3*c* and 3*d*, 4*a*, 4*b* and 4*c*.

Figure 2A:
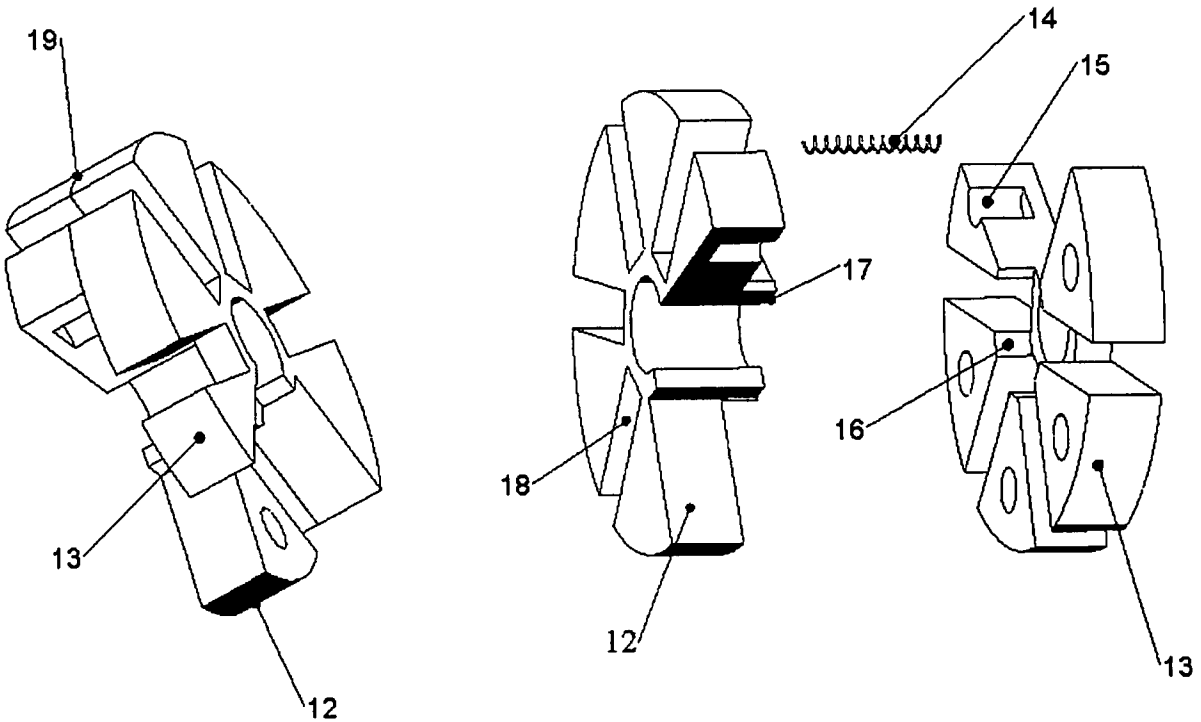
FIG. 2*a* is an exploded view of the rotor segment of the present invention.

With reference to FIG. 2*a*, the rotor of the rotor segment comprises discs 12 and 13 which are pressed apart from each other, that is, biased apart from each other, by springs 14 and thereby providing a press-seal against the face sides of the casing. The springs are located in the bores 15 in both segment discs, which bores do not extend all the way through the discs. Dividing groove 15 is located between the segment discs. The hub 17 of segment disc 12 fits into the reception portion 16 of segment disc 13 and closes the dividing gap 19 according to the cover 10 in FIG. 1. The slots 18 in the segment discs 12 and 13 correspond to the guiding grooves 5 in FIG. 1.

Figure 2B:
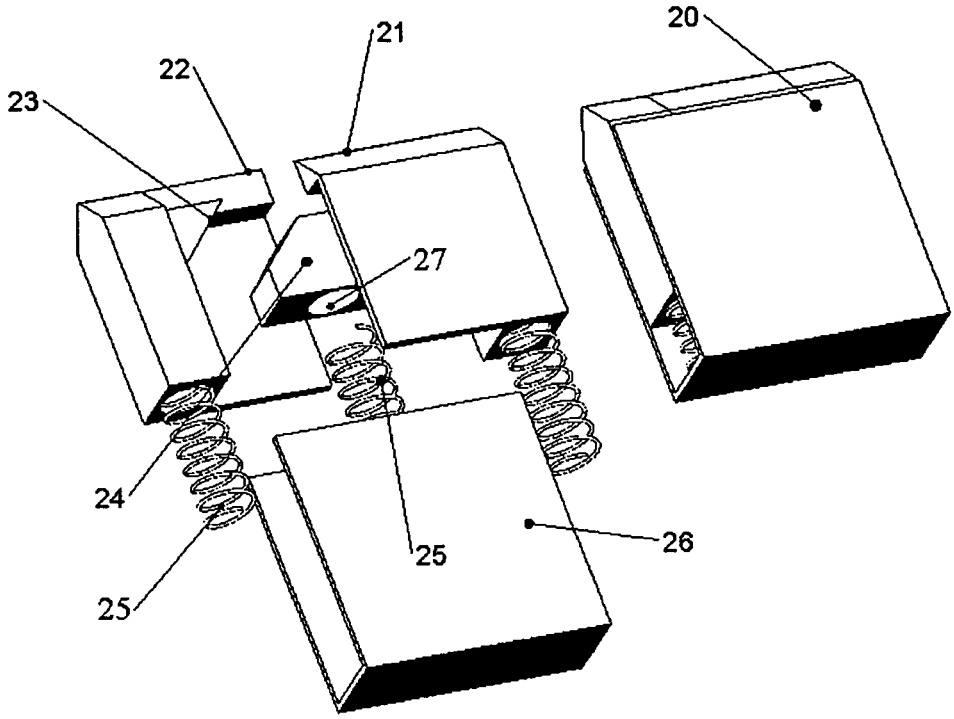
FIG. 2*b* is an exploded view of a blade box of the present invention, and a perspective view of same.

With reference to FIG. 2*b*, the blade boxes 20 are situated in the slots 18 of the rotor, and because of internal spring forces caused by the springs 25 in the blade boxes, the blade boxes adapt in the radial direction onto the face side of the casing and also in the axial direction onto the face side of the casing and, at the same time, reach into the corners between both of axial and radial direction in which the rotor runs in the casing and thus forming a seal along the casing walls.

A blade box contains the two similar half wings 21 and 22 which are assembled with each other such that they are displaced against each other and thereby are pressed against the face side of the casing to form a sealing element. In this arrangement, together with the disc segments 12 and 13, the blade box forms sealing surfaces against the passing of the medium. The pressing force of the half blades 21 and 22 is obtained for this unit by the inside chamfers 23 and the compression wedge 24 sitting on the compression spring 25. The compression wedge 24 is situated in the inner space formed by the half blades 21 and 22. The compression spring 25 sits on the bottom of box hull 27. The radially sealing movement of the half blades 21 and 22 in the course of rotation of the rotor is additionally facilitated by biasing action provided by the springs 26.

Figure 2C:
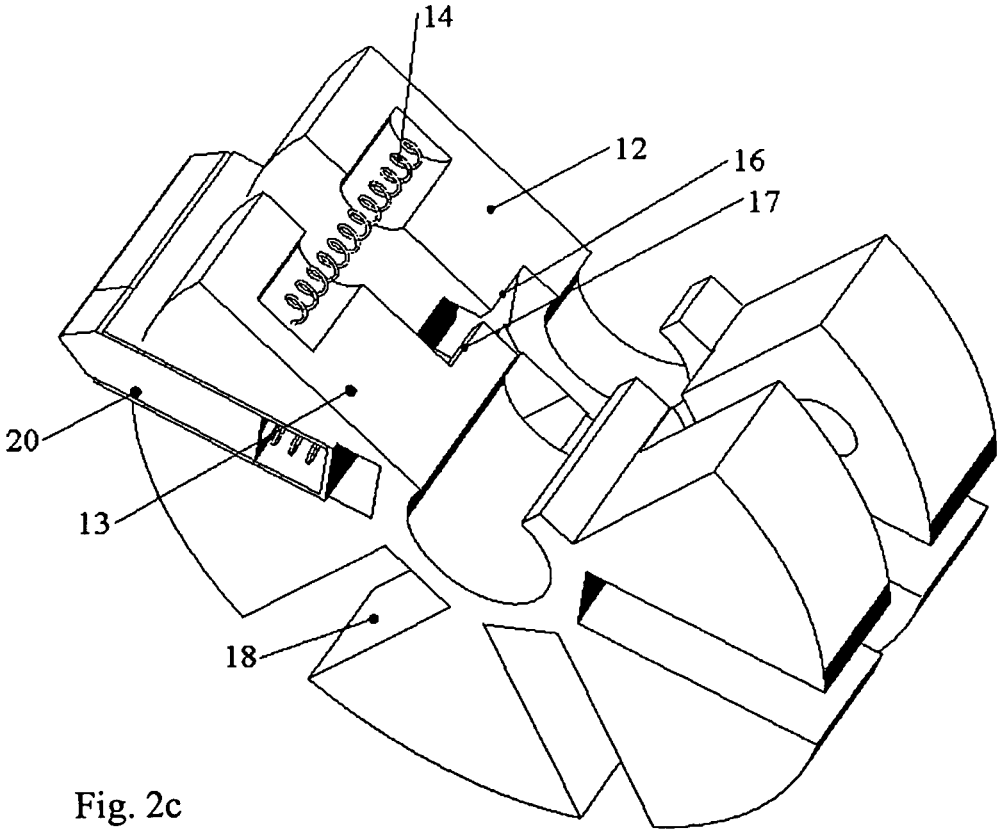
FIG. 2*c* is a cut away view of a rotor segment, also showing a blade box, of the present invention.
Figure 2D:
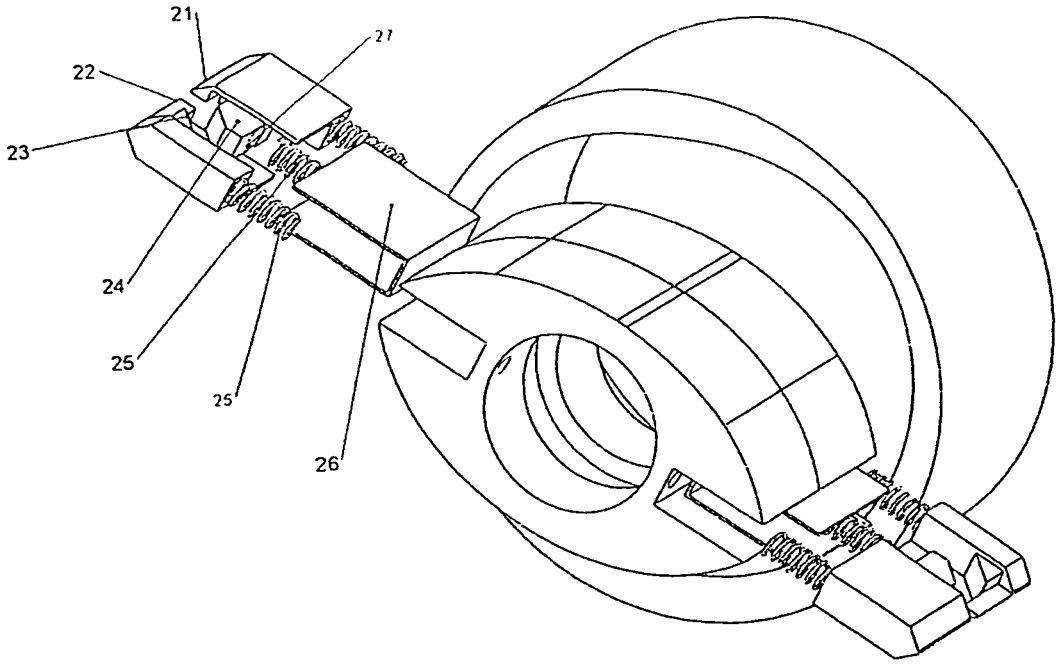
FIG. 2*d* is an exploded view of the blade box relative to the rotor and casing containing each thereof.

FIGS. 2*c* and 2*d* show the interlocking disc segments 12 and 13 with a blade box 20 in slot 18 in the rotor, relative to the surrounding casing.

FIGS. 3*a*, 3*b*, 3*c* and 3*d* show another version of the sealing principle of a rotating piston of the rotor of a Wankel engine.

Figure 3A:
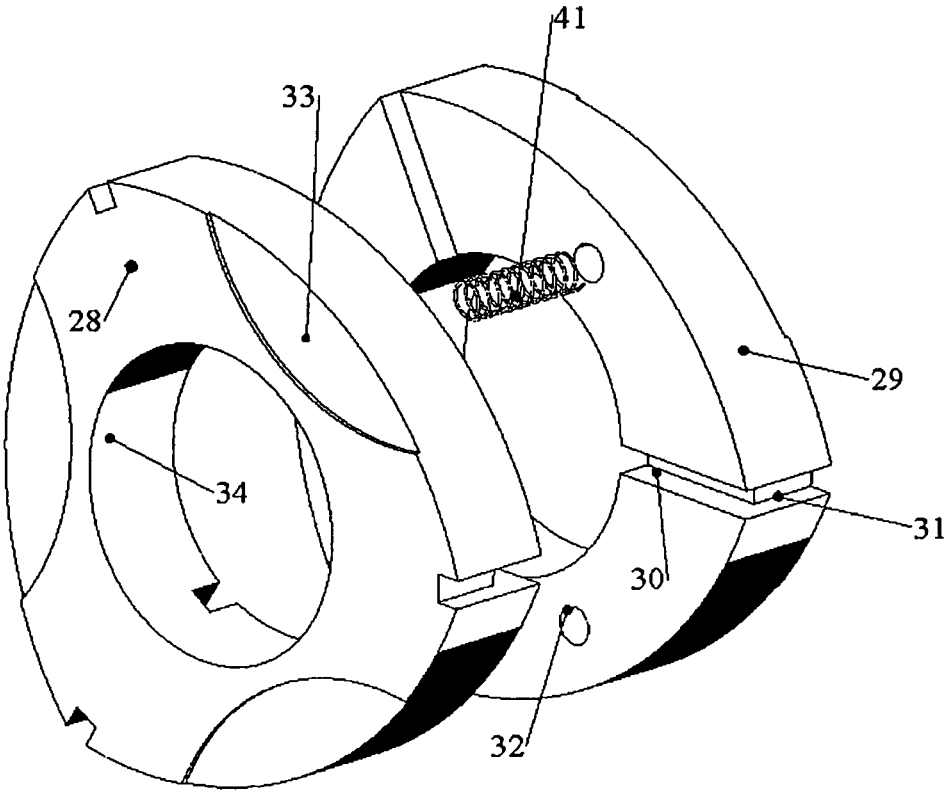
FIG. 3*a* is an exploded perspective view of a Wankel rotor of the present invention.

FIG. 3*a* shows the rotor for a Wankel engine comprising rotor segments 28 and 29 having a similar construction. In the rotor segments three radial grooves 30 are located, extending from the central bore 34 into the three tips of the rotor. The radial grooves 30 extend in the rotor tips into the axial rotor grooves 31. The grooves 30 and 31 receive the flexible sealing elements. Ring 35 is placed into the central bore 34.

Figure 3B:
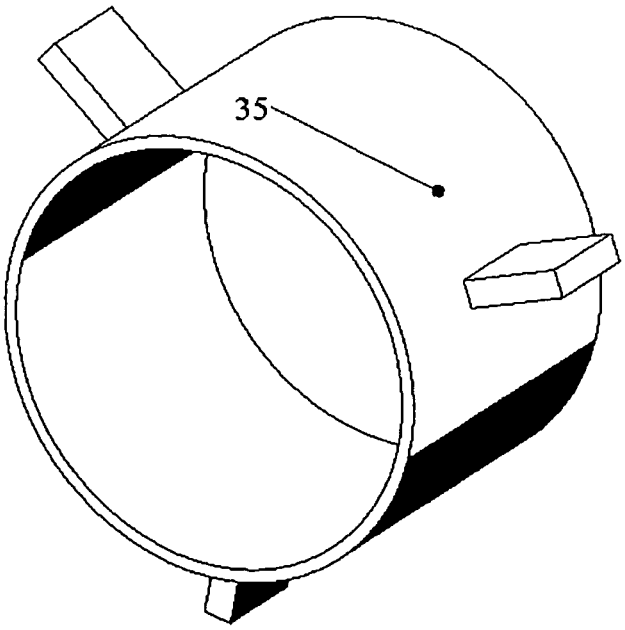
FIG. 3*b* is a perspective view of an internal sealing ring.

FIG. 3*b* shows the ring 35, which is inserted into the bore 34 so that the rectangular gudgeons 36, in other words, fins, attached to the ring sit in the grooves 30 of the rotor segments 28 and 29. Ring 35 serves to seal the gap between the rotor segments against the rotor axle. The gudgeons 36 also seal the groove and at the same time provide support for sealing boxes 39.

Figure 3C:
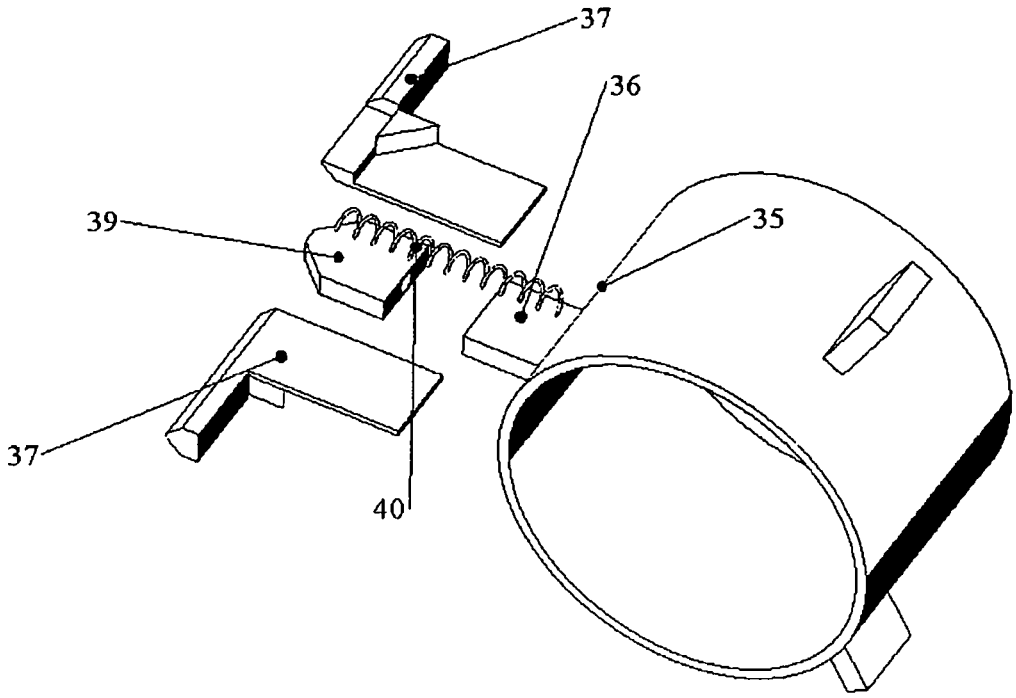
FIG. 3*c* is an exploded view of a sealing arrangement.

FIG. 3*c* shows the construction of a lamellae unit from a pair of members of complementary lamellae members 37, which pair members are placed on top of each other so that their side sealing strips extend away from each other, forming a joint sealing strip with an overlapping gap. In the space between the lamellae 37 a compression wedge 39 is placed. A compression spring 40 presses the compression wedge against the chamfers of the complementary lamellae pairs 37, thus pushing the unit radially to the casing wall and at the same time forcing the members of the lamellae pairs apart so that, during the course of movement of the piston, the lamellae pair edges are pressed into the edges of the casing where the casing walls meet forming a seal. The compression springs 40 are supported on the gudgeons 36. The lamellae 37 cover the gudgeons 36 in such a way that the sealing unit formed can be inserted in the rotor grooves 30 and 31.

Figure 3D:
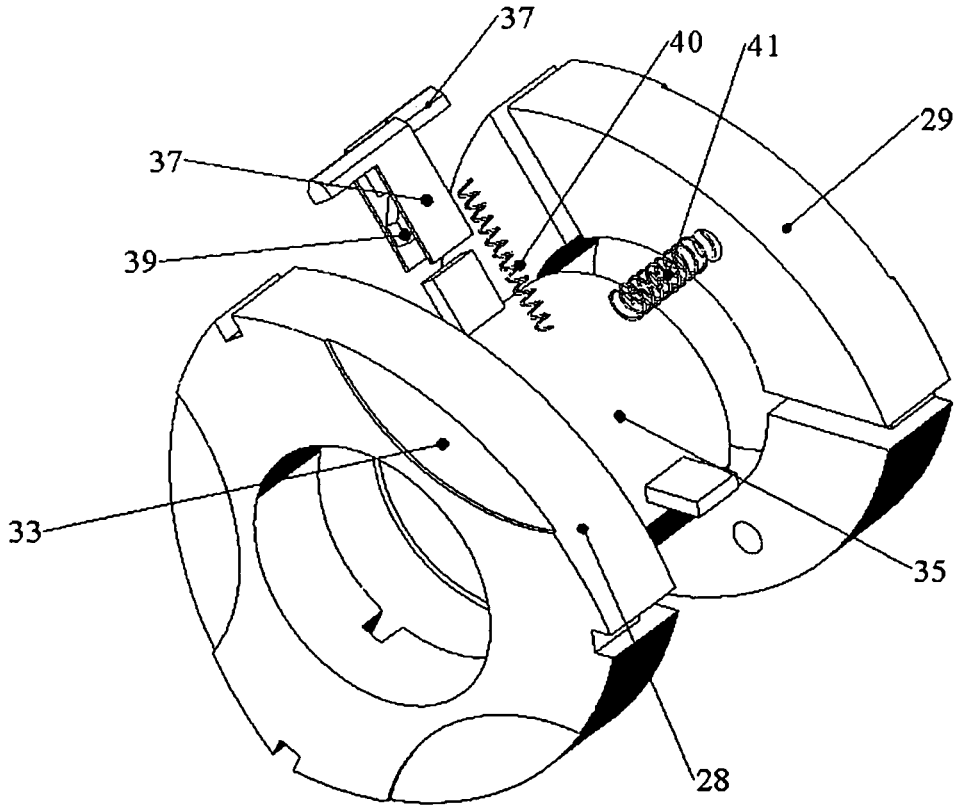
FIG. 3*d* is an exploded view of the rotor segment and sealing arrangement.

FIG. 3*d* shows the sealing unit including the pair of lamellae members 37 forming a unit, the compression wedge 39 and the compression spring 40, which is mounted on to the gudgeon 36 of the sealing ring 35. The sealing ring 35 with the sealing units sits in the grooves 30, 31 of the rotor segments 28, 29. These components form the sealing system of the rotor. The compression springs 41 press the rotor segments 28, 29 on to the face-side areas of the casing. The spring force is required for the rotor segments during the starting phase. When the engine is running, the media pressure (fluid pressure) takes over the pressing function. To reduce the friction on the face-side areas the rotor segments, recesses 33 are provided on the outer faces of the rotor segments, which lessens the pressure exerted on the rotor segments.

Figure 4A:
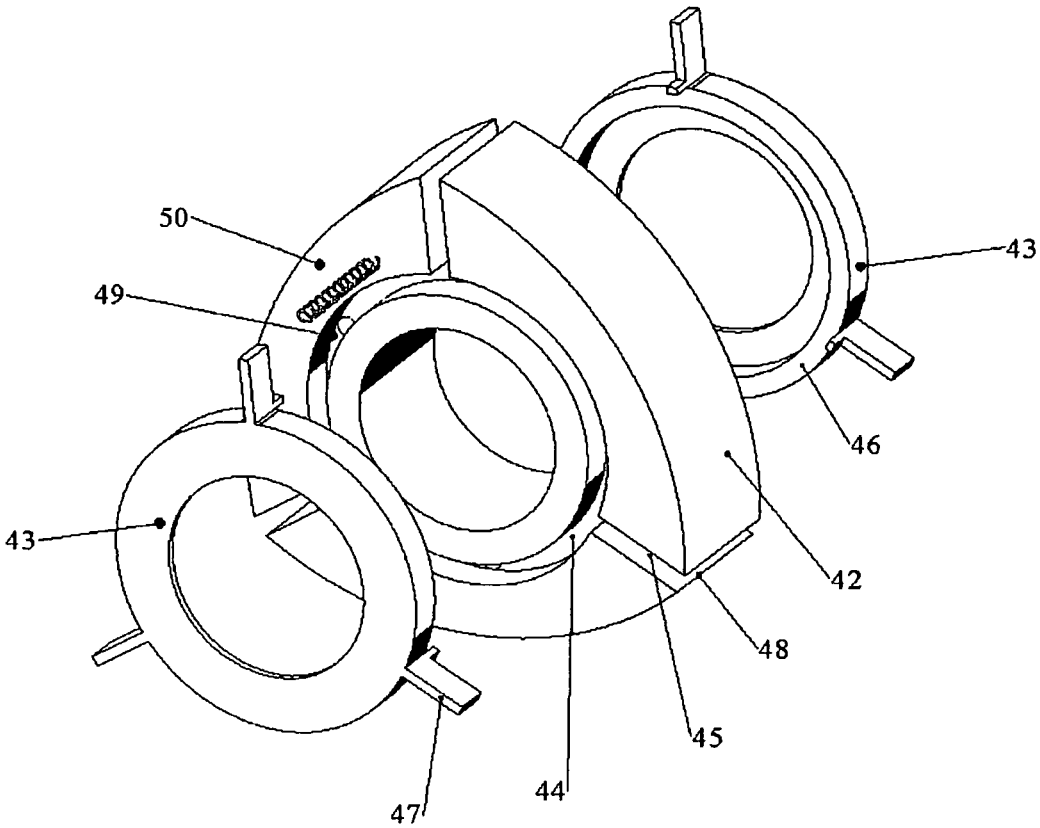
FIGS. 4*a*, 4*b*, 4*c*, 4*d* show the assembly of and assembled Wankel piston.

FIG. 4*a* shows a rotor of a Wankel engine comprising a central rotor segment 42 and the two side rings 43. Both side rings 43 interlock with the recesses 46 and the gudgeons 47 in the side ring grooves 44 and the radial grooves 45 of the piston central part 42. In the piston central part, the through bores 49 house compression springs 50 which are configured to abut the recesses 46 of the side rings 43 and press them against the side walls of the engine, to seal the rotor against a circumferential flow.

The side rings 43 have no function in the transmission of the torque.

Figure 4B:
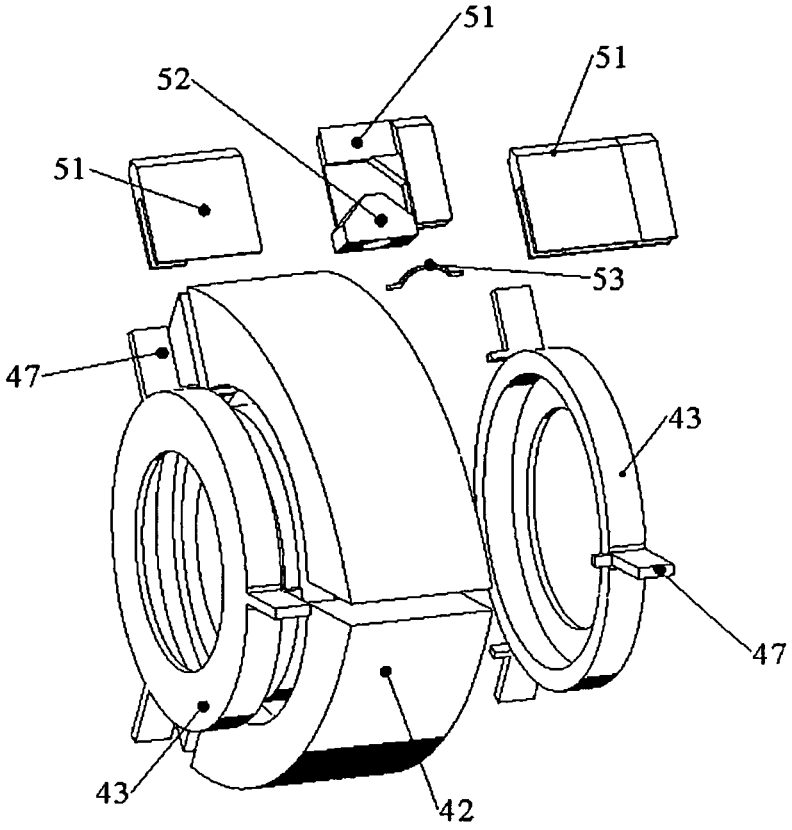
Figure 4C:
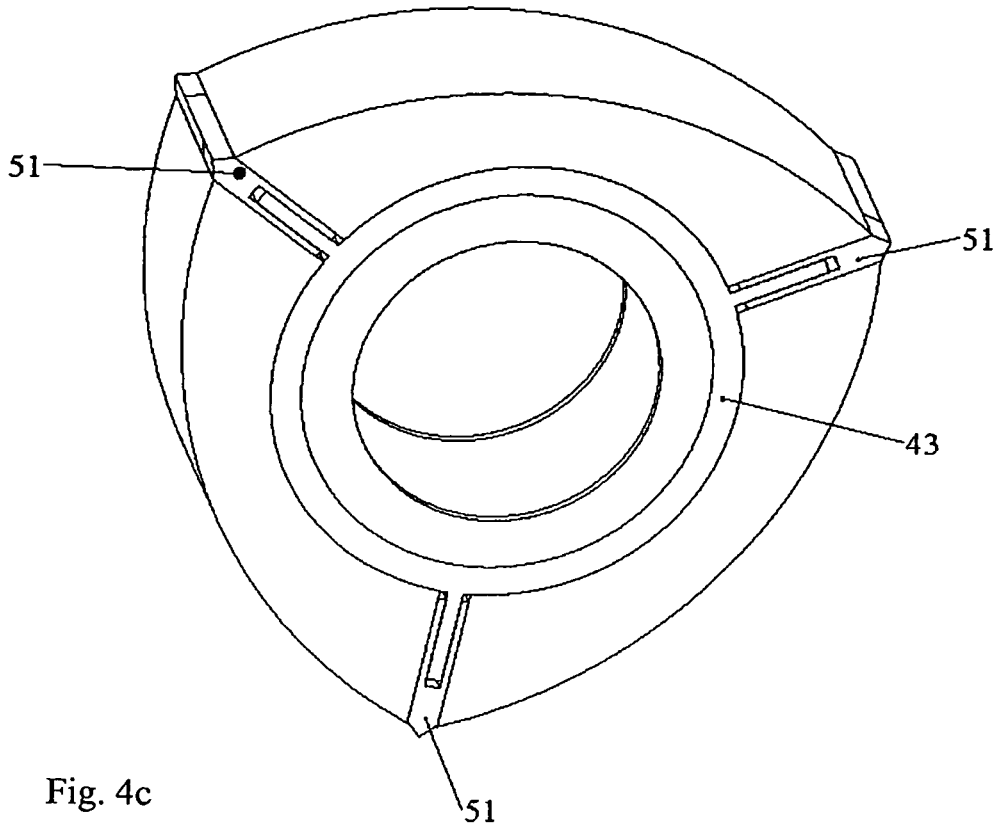
Figure 4D:
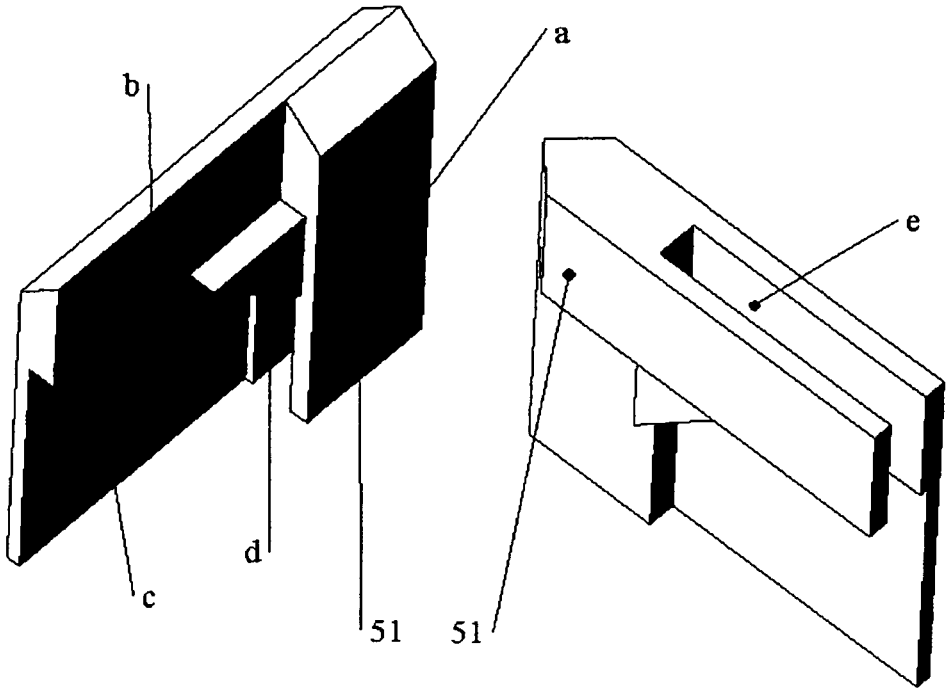

FIG. 4*d* shows a complimentary pair of lamellae 51, in which its full thickness is shown at side 51*a*. At 51*b* the lamella possesses only half its thickness. Two similar lamellae are placed on top of each other, overlapping each other so that they form a lamellae unit which is placed into the cross groove 48 and the radial grooves 45 of the rotor in such a way that both sides 51*a* are facing the rotor side, and the gudgeons 47 of the side rings 43 are positioned in the slots 51*e* to form a closed seal at the side planes of the rotor.

As shown in FIG. 4*b*, two lamellae pair 51, together with cover 51*c*, form a space inside the lamella unit in which compression wedge 52 is located, and when the compression wedge is pressed outward by compression spring 53 it forces the chamfers 51*d* outward. The compression springs 53 are supported by wedges 47, so that the spring force acts in the radial and axial directions on the lamella pair 51, creating a sealing force. In addition, the spring forces applied by the compression springs 53, press the side rings 43 a providing a spring-actuated sealing system, thereby sealing the rotor against the casing wall.

FIG. 4*c* shows the complete rotor, fitted with a plurality of lamellae units comprising lamellae pairs 51. FIG. 4*c* also shows the side rings 43 assembled in the rotor.

Figure 5A:
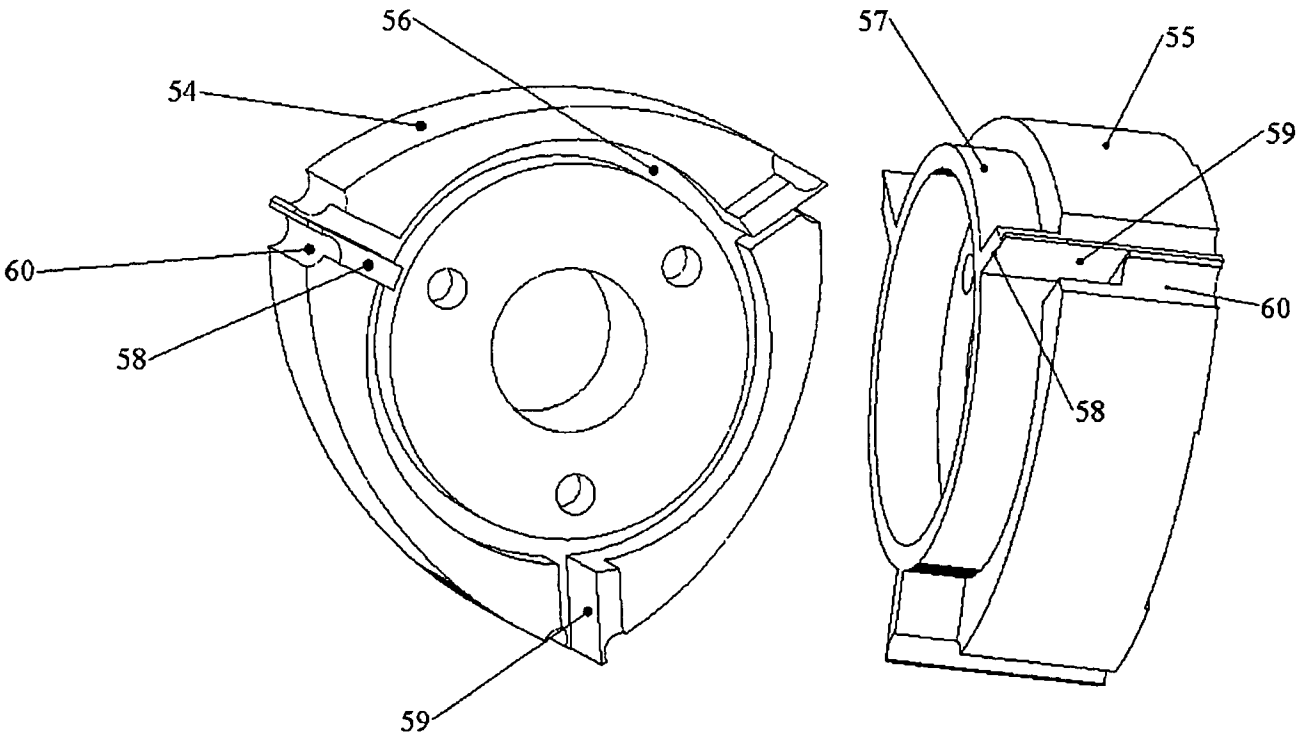
FIGS. 5*a* and 5*b* depict the Wankel piston with fitted sealing strips.

FIG. 5*a* shows the rotor of a rotary piston engine comprising the rotor segments 54 and 55 provided with a seal against the central shaft as a result of the ring-shaped recess 57, which is inserted into ring groove 56. In the same way, the sealing lips 58, which are tightly connected to the rotor segments and comprise the same material, or another tightly inserted material, are inserted. For this purpose, the sealing lips 58 have notches 59 allowing their interlocking. In addition to the sealing lips, the rotor segments 54 and 55 are fitted with mould 60 in a suitable geometric shape having the function of tension release when friction and pressure forces act on the sealing lip 58 in the circumferential direction of the rotor and require an opposite spring action of the sealing lips 58.

Figure 5B:
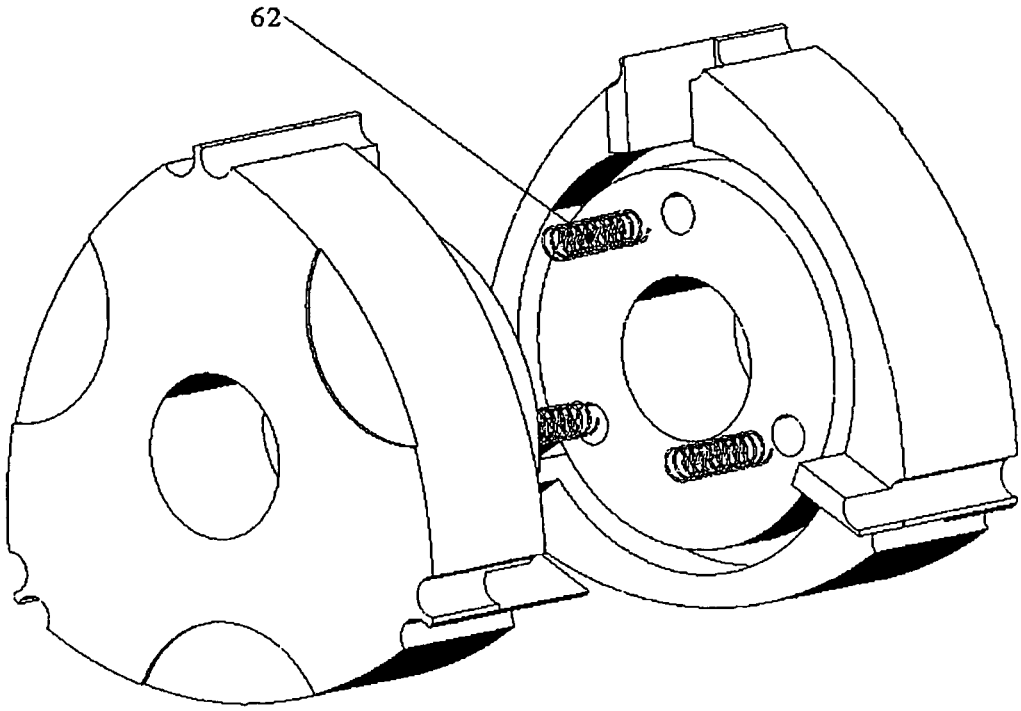

FIG. 5*b* shows the rotor segments 54 and 55 in axle alignment and facing each other in such a way that recess 57 is facing ring groove 56. When inserting rotor segment 55 into rotor segment 54 the sealing lips 58 with their notches 59 are interlocking in such a way that in radial and axial direction of the rotor a dynamic sealing is achieved acting in the direction of rotation of the rotor. Sealing of the rotor segments 54 and 55 against the face-sides of the casing is achieved by the spring force of springs 62. The recesses 63 at the outer sides of the piston segments 54 and 55 cause an almost complete compensation of the media forces acting in the dividing grooves of the rotor segments 54 and 55 as friction forces directed against the face side of the rotor by media forces acting from outside.

The invention claimed is:

1. A sealing system for rotary piston engines comprising a rotor comprising rotor segments arranged next to each other in a casing and forming an opening through which a rotor axle passes, which rotor segments are biased apart by spring force or gas pressure in grooves located between the rotor segments so that face sides of the rotor segments facing side walls of the casing seal against said side walls, the rotor segments comprising axially and radially disposed peripheral guide grooves in each of which is housed a blade box extending entirely between and within substantial portions of said rotor segments thereby forming a seal with said casing, said blade box housing therein rotor portions being respectively adjustable one relative to another so as to seal against said side walls of the casing, said sealing of said blade boxes and said rotor portions preventing access of a fluid to the axle, said rotor portions comprising axially adjustable and radially adjustable lamellae units each comprised of a complementary pair of lamellae arranged to lie over each other when housed within a respective blade box, each of the lamellae being biased by a respective spring, the lamellae units and the blade boxes being positioned on the rotor segments so as to seal an axially-extending space in a sealing arrangement between said rotor segments and further arranged to radially seal the space between the rotor segments and the side walls forming a labyrinth sealing by mutual overlapping of the lamellae units thus achieving a dynamic sealing of the rotor in the axially and radially disposed peripheral guide grooves and along contact points of the rotor with the side walls in a direction in which the rotor runs so as to provide axial and radial sealing of the rotor so as to substantially prevent respective internal and external circumferential flows of fluid around the rotor, an interior space being defined within each of the lamellae and in which a compression spring is housed, and a compression wedge and compression wedge spring housed within the blade box and disposed between the lamellae, each of the lamellae comprising chamfers disposed upwardly with respect to the compression wedge and against which the compression wedge, when biased by the compression wedge spring, is applied so as to press each member of the pair of lamellae apart from each other in the axial direction and to press the lamellae in the radial direction against the side walls of the casing so as to exert a centrifugal force thereupon, and each of the lamellae and the compression wedge being respectively, individually biased so as to move independently of each other, said independent movement between the pair of lamellae and the compression wedge effecting both said axial and radial contact of the lamellae with said side walls of the casing and radial contact of said blade box against portions of said rotor segments which said blade box extends between so as to exert a centripetal force on said rotor segments, said contact of the lamellae with the side walls of the casing together with said housing of the lamellae within the blade boxes and said contact of said blade box against said rotor segments which said blade box extends between forming said labyrinth sealing of the rotor.

2. A scaling system for rotary piston engines comprising a rotor comprising rotor segments arranged next to each other in a casing and forming an opening through which a rotor axle passes, which rotor segments are biased apart by spring force or gas pressure in grooves located between the rotor segments so that face sides of the rotor segments facing side walls of the casing seal against said side walls, the rotor segments comprising axially and radially disposed peripheral guide grooves in each of which is housed a blade box extending entirely between and within substantial portions of said rotor segments thereby forming a seal with said casing, said blade box housing therein rotor portions being respectively adjustable one relative to another so as to seal against said side walls of the casing, said sealing of said blade boxes and said rotor portions preventing access of a fluid to the axle, said rotor portions comprising axially adjustable and radially adjustable lamellae units each comprised of a complementary pair of lamellae arranged to lie over each other when housed within a respective blade box, each of the lamellae being biased by a respective spring, the lamellae units and the blade boxes being positioned on the rotor segments so as to seal an axially-extending space in a sealing arrangement between said rotor segments and further arranged to radially seal the space between the rotor segments and the side walls forming a labyrinth scaling by mutual overlapping of the lamellae units thus achieving a dynamic scaling of the rotor in the axially and radially disposed peripheral guide grooves and along contact points of the rotor with the side walls in a direction in which the rotor runs so as to provide axial and radial sealing of the rotor so as to substantially prevent respective internal and external circumferential flows of fluid around the rotor, an interior space being defined within each of the lamellae and in which a compression spring is housed, and a compression wedge and compression wedge spring housed within the blade box and disposed between the lamellae, each of the lamellae comprising chamfers disposed upwardly with respect to the compression wedge and against which the compression wedge, when biased by the compression wedge spring, is applied so as to abut portions of a topmost surface of the compression wedge extending between side surfaces of the compression wedge against the chamfers so as to press each member of the pair of lamellae apart from each other in the axial direction and to press the lamellae in the radial direction against the side walls of the casing so as to exert a centrifugal force thereupon, and each of the lamellae and the compression wedge being respectively, individually biased so as to move independently of each other, said independent movement between the pair of lamellae and the compression wedge effecting both said axial and radial contact of the lamellae with said side walls of the casing and radial contact of said blade box against portions of said rotor segments which said blade box extends between so as to exert a centripetal force on said rotor segments, said contact of the lamellae with the side walls of the casing together with said housing of the lamellae within the blade boxes and said contact of said blade box against said rotor segments which said blade box extends between forming said labyrinth sealing of the rotor.

3. A sealing system for rotary piston engines comprising a rotor comprising rotor segments arranged next to each other in a casing and forming an opening through which a rotor axle passes, which rotor segments are biased apart by spring force or gas pressure in grooves located between the rotor segments so that face sides of the rotor segments facing side walls of the casing seal against said side walls, the rotor segments comprising axially and radially disposed peripheral guide grooves in each of which is housed a blade box extending entirely between and within substantial portions of said rotor segments thereby forming a seal with said casing, said blade box housing therein rotor portions being respectively adjustable one relative to another so as to seal against said side walls of the casing, said sealing of said blade boxes and said rotor portions preventing access of a fluid to the axle, said rotor portions comprising axially adjustable and radially adjustable lamellae units each comprised of a complementary pair of lamellae arranged to lie over each other when housed within a respective blade box, each of the lamellae being biased by a respective spring, the lamellae units and the blade boxes being positioned on the rotor segments so as to seal an axially-extending space in a sealing arrangement between said rotor segments and further arranged to radially seal the space between the rotor segments and the side walls forming a labyrinth sealing by mutual overlapping of the lamellae units thus achieving a dynamic sealing of the rotor in the axially and radially disposed peripheral guide grooves and along contact points of the rotor with the side walls in a direction in which the rotor runs so as to provide axial and radial sealing of the rotor so as to substantially prevent respective internal and external circumferential flows of fluid around the rotor, an interior space being defined within each of the lamellae and in which a compression spring is housed, and a compression wedge and compression wedge spring housed within the blade box and disposed between the lamellae, each of the lamellae comprising chamfers disposed upwardly with respect to the compression wedge so that the chamfers overhang a topmost surface of the compression wedge extending between side surfaces of the compression wedge, the compression wedge being biased by the compression wedge spring so as to abut portions of the topmost surface of the compression wedge extending between the side surfaces of the compression wedge against the chamfers so as to press each member of the pair of lamellae apart from each other in the axial direction and to press the lamellae in the radial direction against the side walls of the casing so as to exert a centrifugal force thereupon, and each of the lamellae and the compression wedge being respectively, individually biased so as to move independently of each other, said independent movement between the pair of lamellae and the compression wedge effecting both said axial and radial contact of the lamellae with said side walls of the casing and radial contact of said blade box against portions of said rotor segments which said blade box extends between so as to exert a centripetal force on said rotor segments, said contact of the lamellae with the side walls of the casing together with said housing of the lamellae within the blade boxes and said contact of said blade box against said rotor segments which said blade box extends between forming said labyrinth sealing of the rotor.

4. A sealing system for rotary piston engines comprising a rotor comprising rotor segments disposed in parallel, outer surfaces of the rotor segments being biased against faces of a rotor casing in an axial direction of the rotor, rotor segments comprising rotor portions comprising opposed, overlapping lamellae housed within blade boxes which blade boxes are disposed within radially oriented grooves of the rotor segments, the lamellae being adjustable against the casing as a result of the lamellae being actuated by a compression wedge that presses against opposing chamfers of the lamellae positioned radially away from an outermost peripheral surface of the rotor, each of the lamellae and the compression wedge being biased by a respective spring for each of the lamellae and the compression wedge, said springs actuating the respective lamellae, compression wedge and said blade box so as to apply centrifugal and centripetal forces which cause said lamellae, said compression wedge and said blade box to form a labyrinth sealing of said rotor.

5. The sealing system of claim 4, wherein the compression wedge presses against the chamfers of the lamellae so as to adjust the lamellae (a) axially away from each other, and (b) radially, against the casing.

6. The sealing system of claim 4, wherein the compression wedge spring is positioned between a bottom of the compression wedge and a bottom of the blade box.

* * * * *